US005510589A

United States Patent [19]

Arnal

[11] Patent Number: 5,510,589

[45] Date of Patent: Apr. 23, 1996

[54] HIGH-LIFE SEALED SWITCH ASSEMBLY WITH TACTILE FEEDBACK

[75] Inventor: Kevin R. Arnal, Seattle, Wash.

[73] Assignee: Intermec Corporation, Everett, Wash.

[21] Appl. No.: 204,079

[22] Filed: Feb. 28, 1994

[51] Int. Cl.[6] ..... H01H 13/02

[52] U.S. Cl. ..... 200/522; 200/302.2; 200/516; 200/521

[58] Field of Search ..... 200/302.2, 406, 200/522, 516, 517, 521, 1 B

[56] References Cited

U.S. PATENT DOCUMENTS

| | | | |
|---|---|---|---|
| 3,624,330 | 11/1971 | Bognar et al. | 200/302.2 X |
| 3,721,778 | 3/1973 | Seeger, Jr. et al. | 200/517 X |
| 3,999,025 | 12/1976 | Sims, Jr. | 200/516 |
| 4,350,857 | 9/1982 | Fillus et al. | 200/517 X |
| 4,668,843 | 5/1987 | Watanabe et al. | 200/1 B |

FOREIGN PATENT DOCUMENTS

| | | | |
|---|---|---|---|
| 63-308826 | 12/1988 | Japan | 200/516 |

OTHER PUBLICATIONS

Stillwell, Barrie "Low Costs Boost Membranes," New Electron 18(11): 57–58, & 60, 1985.

Hando, T. "Positive Tactile Feedback and Reliability Remain Keys in Small, Push–Button Switches," Journal of Electronic Engineering 22(222): 53–56, 1985.

*Primary Examiner*—Renee S. Luebke
*Attorney, Agent, or Firm*—Seed and Berry

[57] ABSTRACT

A high cycle life switch assembly having a seal positioned between a trigger and a non-tactile switch with a snap dome positioned exterior of the seal and engaged by the trigger to give a high tactile feedback. The snap dome is mounted on the trigger and an actuator rod extends between the snap dome and the switch, through the seal, to apply an actuation force to the switch when the trigger is moved toward an actuating position. The actuator rod extends through an aperture in the seal and is slidably and sealably disposed therein to apply no force on the seal as the actuator rod is moved to actuate the switch located behind the seal.

16 Claims, 3 Drawing Sheets

HIGH-LIFE SEALED SWITCH ASSEMBLY WITH TACTILE FEEDBACK

TECHNICAL FIELD

The present invention relates to switch assemblies, and more particularly, to switch assemblies that provide tactile feedback indicating activation of a switch.

BACKGROUND OF THE INVENTION

Non-tactile switches have been incorporated into electronic switch assemblies used with symbology readers, because the switches are small, lightweight, and inexpensive. A non-tactile switch, such as a multi-layer membrane switch, is constructed so the switch can be easily moved from an open position with an electrical circuit being open to a closed position with the electrical circuit being closed, by applying only a slight pressure to the switch. As a result, the non-tactile switch does not provide tactile feedback to a user indicating when the switch has been moved between the open and closed positions.

Switch assemblies with non-tactile switches have been developed with a tactile element immediately adjacent to the switch so the tactile element will provide tactile feedback to a user indicating closure of the switch. A tactile element that provides a high tactile response or feedback typically exerts high stress loads on the feedback element in order to provide a crisp, snapping feel to the user. However, the high tactile feedback element can only withstand the high stress loads for a relatively low number of switch cycles before failure occurs. Thus, the high stress loads on the high tactile feedback element result in a low cycle life of the switch assembly, and the low cycle life requires frequent replacement of the switch assembly.

High cycle life switch assemblies have been developed by using weak or low tactile feedback elements immediately adjacent to the non-tactile switches. This has been possible because the low tactile feedback elements create smaller stress loads. The smaller stress loads, however, result in a switch assembly having a feel that is mushy and not crisp, thereby making it difficult for a user to clearly identify when the switch has moved between the open and closed positions.

While having the benefit of being small, lightweight and inexpensive, the non-tactile switches are delicate and are easily damaged by water, dust or other contaminants. Switch assemblies have incorporated protective seals to protect the delicate switches such that a trigger, which is accessible to a user, is located on one side of the seal, and a tactile element and the non-tactile switch are located on an opposite side of the seal. Although the seal protects the non-tactile switch, the seal also dampens the tactile feedback generated by the tactile element, so the sealed tactile switch assembly has lower tactile feedback and, thus, a mushy feel. The mushy feel has been reduced by incorporating higher tactile feedback elements that create the larger stress loads, but as described above, this lowers the cycle life of the assembly. Thus high tactile feedback in conventional switch assemblies had to be compromised to gain high cycle life, and high cycle life had to be compromised to gain high tactile feedback.

A further drawback to a conventional sealed tactile switch assembly is that a compression force is repeatedly applied directly against the seal by the trigger to move the tactile element and the non-tactile switch. Over the life of the switch assembly, these repetitious compression forces applied to the seal wear on the seal and cause seal failure. This results in a lower cycle life for the switch assembly.

As such, there is a need for a sealed switch assembly utilizing a non-tactile switch that provides a high cycle life in conjunction with crisp or high tactile feedback and that protects the switch from damage due to water, dust, or other contaminants.

SUMMARY OF THE INVENTION

The present invention provides a switch assembly using a sealed non-tactile switch and having a high cycle life and high tactile feedback that indicates activation of the switch. In a preferred embodiment of the invention, the switch assembly includes a non-tactile switch mountable in a housing and a trigger that is movably attached to the housing and coupled to the switch so the switch can be moved between open and closed positions when the trigger is moved between inactive and active positions. A seal is located between the trigger and the switch to form a protective seal therebetween, and an actuator is located between the trigger and the switch so as to move the switch to the closed position when the trigger is moved toward the active position. A tactile member is positioned outward of the seal between the trigger and the switch. The tactile member provides a user with a high tactile indication that the trigger has been moved to the active position and that the switch has been moved from the open position to the closed position.

Accordingly, the switch and tactile member in the preferred embodiment are separated by the seal, so the tactile member is adjacent to the trigger in an unsealed area of the switch assembly and the switch is in a sealed area of the switch assembly.

In the preferred embodiment of the invention, the tactile member is a resilient, collapsible snap dome adapted to be moved from an extended position to a collapsed position, thereby creating a snapping action that generates a high tactile indication. In an alternate embodiment of the invention, the switch is a non-tactile sensor that senses, for example, the amount of force exerted on the switch by the switch actuator when the trigger is moved toward the active position. When the force reaches a predetermined level, the sensor provides a signal to an electronic device or the like which performs a predetermined function, and the tactile member provides an indication to a user of the function activation.

DETAILED DESCRIPTION OF THE INVENTION

Figure 1:
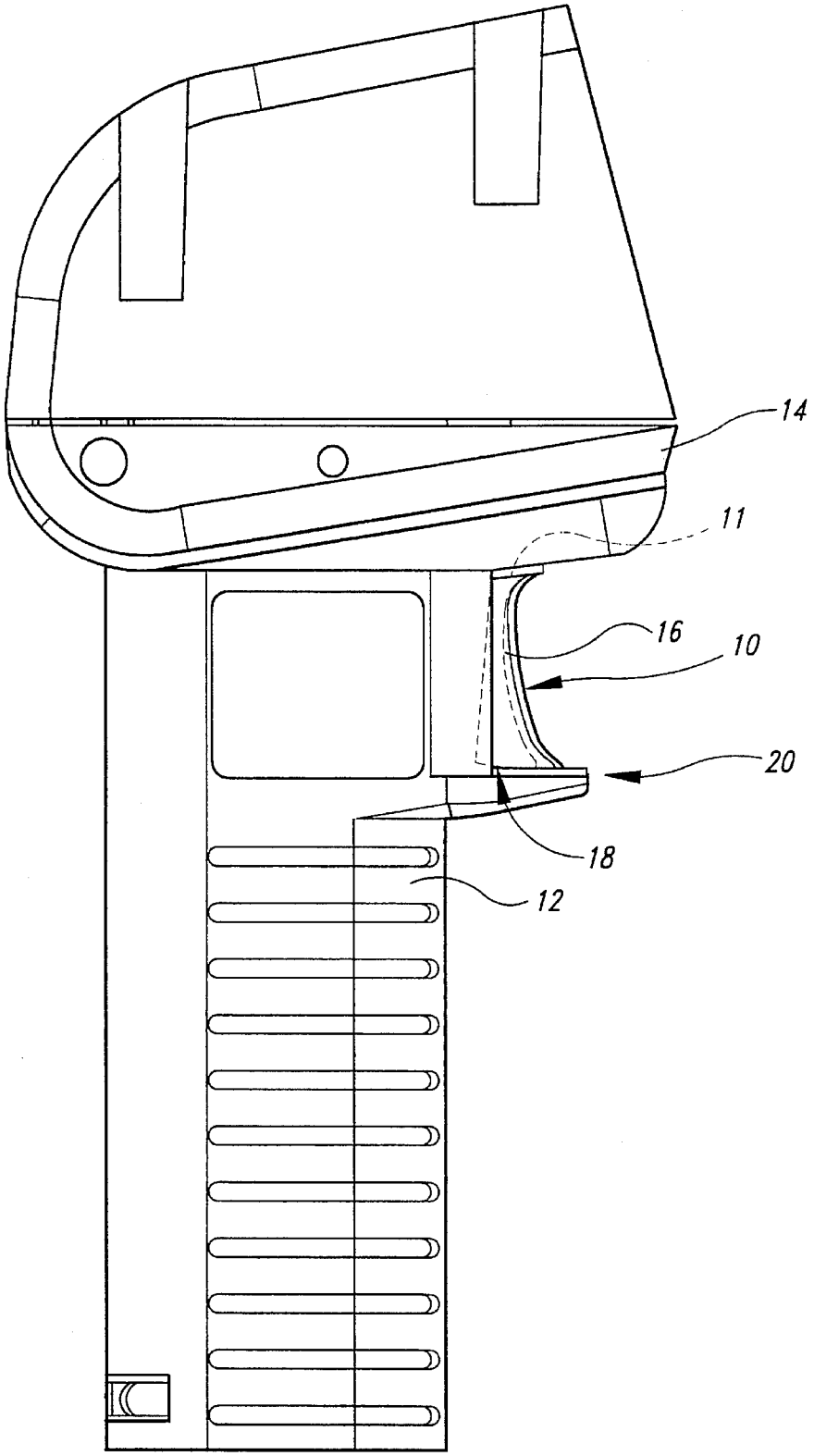
FIG. 1 is a side elevation view of a switch assembly in accordance with the present invention mounted on a handle of a hand held electronic device with a trigger shown in an inactive position in solid lines and in an active position in phantom lines.

As best seen in FIG. 1, a switch assembly 10, in accordance with the present invention, is mounted in an aperture 11 formed in a handle 12 of an electronic device 14 such as a symbology reader or the like. The switch assembly 10 has a trigger 16 that is used by a user to activate the electronic device. The trigger 16 extends outward from a front side 20 of the handle and is accessible to the user. The switch assembly 10 activates the electronic device 14 when the trigger 16 is depressed inward toward the handle 12 and moved from an inactive position, shown in solid lines, to an active position, shown in phantom lines. The switch assembly 10 creates a crisp feel or high tactile indication that is transmitted through the trigger 16 and detectable by the user, thereby indicating when the trigger has been moved to the active position.

Figure 2:
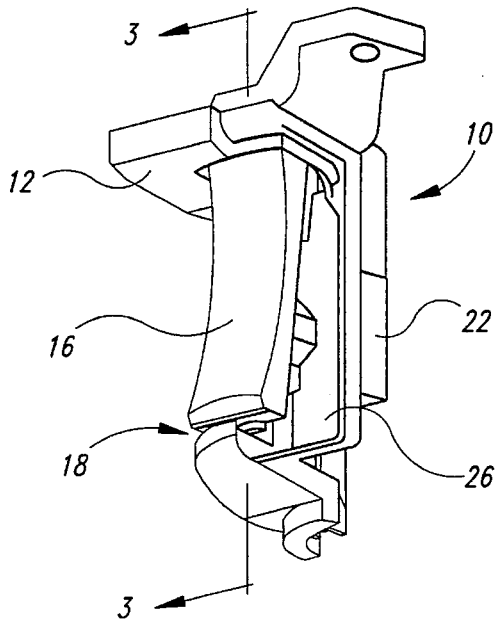
FIG. 2 is an enlarged fragmentary, bottom left isometric view of the switch assembly of FIG. 1 with a side portion of the handle cut away.
Figure 3:
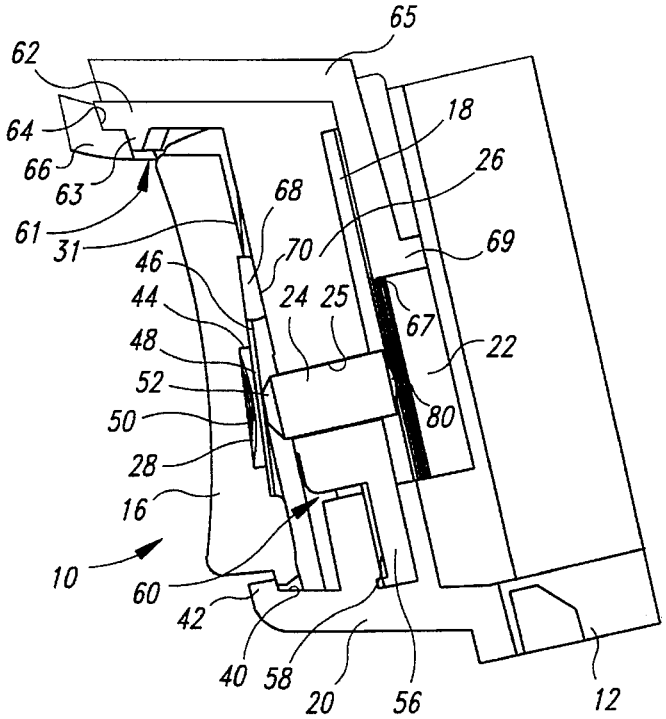
FIG. 3 is an enlarged cross sectional view taken substantially along line 3—3 of FIG. 2.

As best seen in FIGS. 2 and 3, the trigger 16 of the switch assembly 10 is mounted to the handle 12 forward of and adjacent to a switch seal 26 that is positioned within the aperture 11 and sealably engages the handle 12. The seal 26 is positioned forward of and adjacent to a non-tactile switch 22 mounted on the handle 12, within the aperture 11, so the seal is located between the trigger 16 and the switch. Accordingly, the switch 22 is located in a sealed area within the handle 12 and is protected from being damaged by water, dust, or other contaminants to which the handle and trigger 16 may be exposed during use. The switch 22 is coupled to the trigger 16 by a switch actuator 24 shown in FIG. 3 that extends through and is slidably and sealably disposed in an aperture 25 in the seal 26. The switch actuator 24 presses against the switch 22 when the trigger is moved toward the active position to transmit a user-supplied activation force on the trigger to the switch.

The switch 22 is a membrane switch that moves between an open position and a closed position without providing a substantial tactile indication to the user that, for example, the switch has been closed. Crisp or high tactile indication of switch movement is provided to the user by a snap dome 28 that is mounted on the trigger 16 and positioned between the trigger and an outward end of the switch actuator 24. The snap dome 28 is a resilient, collapsible rearwardly facing convex member that is biased to a relaxed arched position as shown in FIG. 3 and is adapted to move to a collapsed position when a sufficiently high force is applied thereto.

When the user exerts force on the trigger 16 and the trigger is moved toward the active position, the force is applied through the snap dome 28 to the switch actuator 24 and then transmitted to the switch 22. When the force reaches a predetermined level, the snap dome 28 moves to the collapsed position with a snapping action that creates the high tactile indication, which is transmitted through the trigger 16 to the user. At this predetermined force level the switch actuator 24 also presses against the switch 22 with sufficient force to move it toward the closed position. The switch 22 and snap dome 28 are matched so that, when the force is great enough to move the switch 22 to the closed position, the snap dome 28 will be snapped to the collapsed position at substantially the same time. Thus the switch assembly 10 provides a high tactile indication to the user that the switch 22 has been moved to the closed position so that the user will clearly know when the switch has activated the electronic device 14. The switch actuator 24 is a compressible member that is adapted to be compressed between the snap dome 28 and the switch 22 when, for example, the trigger is in the second position and a force is exerted on the trigger, thereby protecting the switch from being damaged. It is noted that a/though the switch 22 is described as a single switch circuit having a single open position and a single closed position with respect to the operator of the snap dome 28, in the preferred embodiment of the switch there is another switch circuit which is activated by movement of the trigger 16 that occurs before the snap dome snaps to the collapsed position. This will be described in greater detail below.

Although the preferred embodiment uses a snap dome 28, other tactile members can be used that provide a crisp or high tactile indication. For example, other suitable tactile devices include a resilient buckling element that will buckle and create the tactile indication, or a resilient collapsing beam element that will collapse and create the tactile indication when sufficient force is exerted thereon. These devices return to unbuckled or uncollapsed positions when the force is removed.

Figure 4:
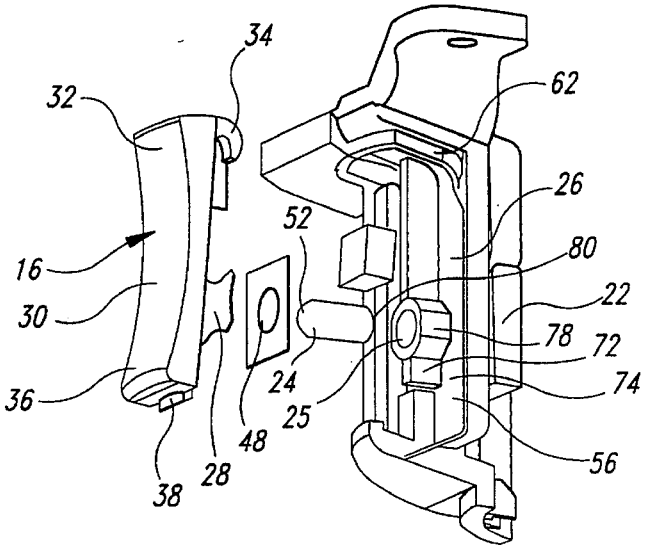
FIG. 4 is an enlarged exploded bottom left isometric view of the switch assembly of FIG. 2.
Figure 5:
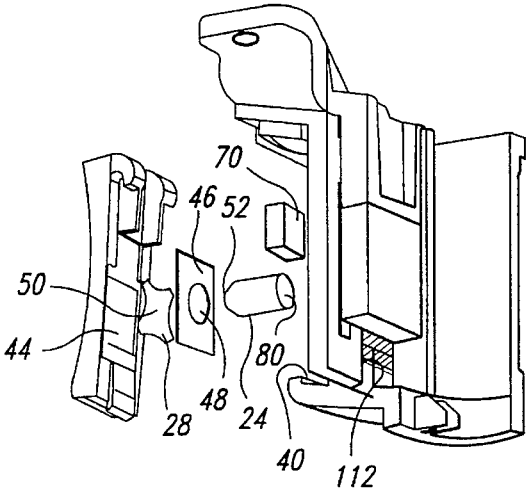
FIG. 5 is an enlarged exploded bottom left isometric view of the switch assembly of FIG. 2, shown from the rear.

As best seen in FIGS. 4 and 5, the trigger 16 has a forward facing portion 30 that is contacted by the finger of the user, a rearward facing portion 31 that engages the snap dome 28, a top portion 32 that pivotally attaches the trigger to the handle 12 with retaining hooks 34, and a bottom portion 36 having a downwardly extending tab 38. The tab 38 extends into a receiving area 40 of the handle 12 with an upwardly extending forward lip 42 positioned forward of the tab to limit the forward travel of the tab, and hence prevent the trigger 16 from moving forward beyond the inactive position, as shown in FIG. 3. When the trigger 16 is moved toward the active position, the tab 38 moves rearwardly with the trigger and passes rearward through the receiving area 40.

The snap dome 28 is positioned in a square recess 44 in the rearward portion 31 of the trigger 16. A flexible snap dome cover 46 is attached along its edge portion to the rearward portion 31 of the trigger 16 over the snap dome to retain the snap dome 28 within the recess 44. The snap dome cover 46 has a central aperture 48 therein sized to allow a forward, tapered end portion 52 of the switch actuator 24 to extend therethrough and firmly contact a center portion 50 of the snap dome 28 as the trigger 16 is moved toward the active position. As the snap dome 28 presses against the forward end portion 52 of the switch actuator 24, a rearward end portion 80 of the switch actuator 24 presses against the switch 22 and moves the switch toward the closed positions.

The seal 26, shown in FIG. 3, is an elastomeric member, substantially L-shaped in cross section, having an elongated wall 56 that fits within a retaining groove 58 extending along a bottom portion 60 of the aperture 18 and along the left and fight sides of the aperture 11. The aperture 25 of the seal 26 is formed in the lower wall 56. An upper wall 62 of the seal 26, transverse to the lower wall 56, fits within a recess 64 along an upper portion 61 of the aperture 18. The upper wall 62 has a downwardly extending ridge 63 that engages an edge wall portion 66 of the handle 12 about the upper portion 61 of the aperture 18.

The lower wall 56 of the seal shown in FIG. 4 has a fib 72 extending between the upper wall 62 and beyond the aperture 25 of the seal 26, and projects forward from a forward side 74 of the seal to provide structural rigidity to the seal. The fib 72 is formed integral with a cylindrical wall 78 that extends about, and in pan forms, the aperture 25 through the seal 26. The cylindrical wall 78 and the aperture 25 through the lower wall 56 of the seal are sized to slidably and sealably receive the switch actuator 24 therein.

The switch actuator 24 is an elastomeric rod having an outside diameter substantially equal to the inside diameter of the cylindrical wall 78 and the aperture 25 in the seal 26. As such, the cylindrical wall 78 not only sealably engages the switch actuator 24, but it also provides a strengthened structure around the aperture 25 to minimize wear on the seal 26. The switch actuator 24 freely slides within the cylindrical wall 78 when the snap dome 28 presses on the switch actuator as the trigger 16 is moved toward the active position without significant flexure of the seal 26. Thus highly repetitious compression forces are not exerted on or through the seal 26, and the seal is not stressed on each cycle in which the switch 22 is activated. At least in part, this accounts for durability and long cycle life of the switch assembly 10. Also, it prevents the seal 26 or its flexibility from impacting on the movement or feel of the switch assembly 10.

As best seen in FIG. 3, the seal 26 and the switch 22 are held in place within the handle 12 against upward movement by a rigid seal retainer 65 that is fastened to the handle. The seal retainer 65 is a plastic, electrically non-conductive member that extends above the upper wall 62 of the seal 26, and downwardly in a position rearward of the lower wall 56 of the seal. An end 69 of the seal retainer 65 engages a top portion 67 of the switch 22 to securely retain the switch against upward movement and in position for engagement by the rearward end portion 80 of the switch actuator 24.

The trigger 16 is biased toward the inactive position by a foam block 68 that is adhered to the rearward facing portion 31 of the trigger 16 above the recess 44. A rearward surface 70 of the foam block 68 engages the rib 72 of the seal 26. As a result, the foam block 68 is compressed between the trigger 16 and the rib 72 when the trigger is moved toward the active position. The compression of the foam block 68 creates a forward biasing force for return of the trigger 16 to the inactive position and provides resistance to rearward movement of the trigger 16 before the snap dome 28 snaps to the collapsed position. The resistance provides the user with a soft tactile feel as the trigger is moving toward the active position before the snap dome 28 is engaged by the forward end portion 52 of the switch actuator 24 and the snap dome collapses. This provides the switch assembly 10 with a mushy feel as the foam block 68 compresses and a crisp snap feel as the snap dome collapses.

Figure 6:
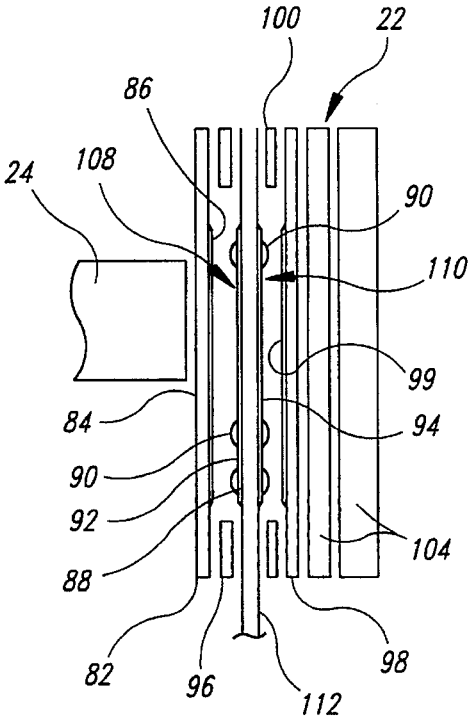
FIG. 6 is a reduced, fragmentary side view of a multi-layer membrane switch and actuator of the switch assembly of FIG. 3.

As best seen in FIG. 6, in the illustrated embodiment of the invention, the switch 22 is a multi-layer membrane switch forming two switch circuits 108 and 110. The membrane switch has a forward layer 82, which includes a forward surface 84 that is contacted by the switch actuator 24 and an electrically conductive rearward surface 86. A conductive middle layer 88 is held spaced apart from the forward layer 82 by a forward spacer layer 96. The middle layer 88 is connected to an electrical ground. A rearward layer 98 having an electrically conductive forward surface 99 is mounted on a rigid substrate 104 and held spaced apart from the middle layer 88 by a rearward spacer layer 100. Spacer dielectric dots 90 are mounted on both a conductive forward surface 92 and on a conductive rearward surface 94 of the middle layer 88 and extend into the spaces between the layers 82, 88, and 98. The dots 90 are arranged to leave a middle area of the forward layer 82 and the middle layer 88 open and free to flex rearward to allow the conductive rearward surface 86 of the forward layer 82 to engage the conductive middle layer 88 and the middle layer to engage the conductive forward surface 99 of the rearward layer 98 when force is applied to the middle area by the switch actuator 24. The first switch circuit 108 is normally open and is closed when the conductive rearward surface 86 of the forward layer 82 contacts the conductive middle layer 88. The second switch circuit 110 is normally open and is closed when the conductive middle layer 88 contacts the conductive forward surface 99 of the rearward layer 98.

When the trigger 16 moves the switch actuator 24 rearward against the forward surface 84 of the forward layer 82 of the switch 22, the forward layer deflects rearward until the electrically conductive rearward surface 86 contacts the conductive forward surface 92 of the middle layer 80, thereby closing the first circuit 108. In the preferred embodiment, the force required to close the first switch circuit 108 is not sufficient to collapse the snap dome 28, As such, the user pulling the trigger 16 encounters the mushy feel produced by the foam block 68. As the force applied by the user on the trigger 16 increases, the forward layer 82 and the middle layer 88 deflect together and until the conductive rearward surface 94 of the middle layer contacts the conductive forward surface 99 of the rearward layer 98, thereby closing the second circuit 110. As noted above, the snap dome 28 and the switch 22 are selected so that the snap dome will move to the collapsed position at about the same time the switch closes the second circuit. Accordingly, the switch 22 has a first position when both switch circuits 108 and 110 are normally open, a second position when the first switch circuit is closed and the second switch circuit remains normally open, and a third position when both the first and second switch circuits are closed. A three-conductor switch cable 112 is connected to the forward layer 82, middle layer 88, and the rearward layer 98 of the switch 22 and electrically connects the switch to the electronic device 14.

In the preferred embodiment, the selection of the switch 22 and the snap dome 28 is made such that the amount of force required to close the first switch circuit 108 is less than the force required to snap the snap dome 28 to the collapsed position, and the force required to close the second circuit 110 is about the same force required to snap the snap dome. As such, when the trigger 16 moves toward the active position and the switch actuator 24 is pressed against the switch 22, the first switch circuit 108 closes before the snap dome 28 collapses and the second switch circuit 110 closes as the snap dome 28 collapses or immediately after the snap dome collapses. The second switch circuit 110 may be selected to close just after collapse of the snap dome 28.

The two-circuit switch 22 provides for a three-position switch assembly 10. The trigger 16 can be moved between a first position with the switch 22 having both switch circuits 108 and 110 open, a second intermediate position with the switch having the first switch circuit closed and the second switch circuit open, and the fully depressed third position with the switch having both switch circuits closed. When the electronic device 14 is a symbology reader, the first position corresponds to the symbology reader being off and not active. The intermediate second position corresponds to the symbology reader emitting a spotting beam to spot a symbology such as a bar code. The third position corresponds to the symbology reader reading and identifying the symbology.

After the switch assembly 10 has been moved to the third position and the user releases their finger from the trigger 16, the switch assembly moves through a return stroke with the trigger 16 returning to the first position and the switch circuits moving to the open positions. As indicated above, the foam block 68 is compressed when the trigger 16 is in the third position, and the snap dome 28 is in the collapsed position. Both the foam block 68 and the snap dome 28 push the trigger 16 toward the first position. As sufficient force is removed from the trigger 16, the snap dome 28 snaps from the collapsed position to the relaxed arched position, and the snapping action provides a tactile indication to the user of such movement. The second switch circuit 110 moves to the open position at about the same time as the snap dome 28 returns to the relaxed arched position. Accordingly, the switch assembly 10 provides a tactile indication to the user on the return stroke indicating when the second switch circuit 110 is open. After the snap dome 28 has snapped to the relaxed arched position, the foam block 68 pushes the trigger 16 to the first position. The first switch circuit 108 moves to the open position as the foam block 68 pushes the trigger 16 back toward the first position. As such, the switch assembly 10 resets itself with the switch circuits 110 and 112 in the open position and the trigger 16 in the first position and ready to move through another switch cycle.

In an alternate embodiment of the present invention, the switch 22 takes the form of a sensor, such as a piezoelectric device, load-cell, strain gauge or the like, that senses the amount of force being exerted on the sensor by the switch actuator 24. The sensor is monitored using monitoring software (not shown) that monitors the degree of force being applied to the sensor and provides commands or other signals to the electronic device 14. As the force changes levels, the software can activate different electro-mechanical functions of the electronic device. For example, when the force is applied to the switch assembly 10, which is operatively mounted in a symbology reader, and the force transmitted from the trigger 16 to the sensor reaches 200 grams, the monitoring software activates a spotting beam to facilitate focusing the symbology reader on a bar code. When the force on the sensor reaches 300 grams, the software activates the reading function. The snap dome 28 is calibrated to snap to the collapsed position when the force exerted through the switch actuator 24 reaches 300 grams. As a result, the snap dome 28 collapses and provides the high tactile indication to a user that the symbol is being read at substantially the same time the software activates the reading function.

Numerous modifications and variations of the sealed switch assembly disclosed herein will occur to those skilled in the art in view of this disclosure. For example, a multi-level switch having four or more positions could be used to obtain a multiple position assembly, or other tactile members could be used to provide a high tactile indication to the user. Therefore, it is to be understood that these modifications and variations and equivalents thereof may be practiced while remaining within the spirit and scope of the invention as defined by the following claims.

I claim:

1. A switch assembly providing a tactile indication to a user of switch activation, the switch assembly being mountable in a housing having an aperture, comprising:

a non-tactile switch mounted within the housing, said switch being adapted to move between an open position and a closed position without providing a substantial tactile indication to the user of movement by said switch;

a trigger movably attached to the housing, said trigger being adapted to move between a first position and a second position, said trigger being coupled to said switch to move said switch from said open position to said closed position when said trigger is moved from said first position to said second position;

a trigger biasing member connected to the trigger, said trigger biasing member biasing said trigger toward said first position and providing resistance to said trigger when said trigger is moved toward said second position;

a seal positioned between said trigger and said switch and sealably engaging the housing to close the housing aperture, said seal having an aperture therethrough;

a switch actuator coupling said trigger to said switch, said switch actuator extending through said aperture in said seal and being movably disposed in said seal aperture, said switch actuator being positioned and adapted to move said switch from said open position to said closed position when said trigger is moved from said first position to said second position; and a tactile member positioned outward of said seal, between said trigger and said switch with said seal being located between said tactile member and said switch, and adapted to be engaged by said trigger as said trigger is moved from said first position toward said second position, and to provide the user with a tactile indication that said switch has been moved from said open position to said closed position.

2. The switch assembly of claim 1 wherein said tactile member is a resilient, collapsible dome adapted to be moved from an arched position to a collapsed position when said trigger is moved toward said second position, said dome being adapted to snap with a snapping action into said collapsed position, said snapping action creating said tactile indication that is transmitted through said trigger and detectable by the user, said dome being biased toward said arched position.

3. The switch assembly of claim i wherein said tactile device is a movable element that moves between a primary position and a secondary position when said trigger is moved between said first position and said second position, said tactile indication occurring as said movable element moves between said primary position and said secondary position.

4. The switch assembly of claim 1 wherein said tactile device is a collapsible element movable from an uncollapsed position to a collapsed position when said trigger is moved toward said second position.

5. The switch assembly of claim 1 wherein said tactile device in a first state resists movement of said trigger with a first opposing force, said trigger being moved by a force applied to said trigger, and upon the force applied to said trigger exceeding a predetermined increased level, said tactile device transitions to a second state resisting movement of said trigger with a second opposing force less than the first opposing force.

6. The switch assembly of claim 1 wherein said tactile member is mounted on said trigger, said tactile indication being transmitted through said trigger and being detectable by the user.

7. The switch assembly of claim 1 wherein said switch actuator is slidably disposed in said seal aperture.

8. The switch assembly of claim 1 wherein said switch actuator sealably engages said seal as said switch actuator moves within said seal aperture.

9. The switch assembly of claim 1 wherein said switch is a multi-layer membrane switch.

10. A switch assembly providing a tactile indication to a user of switch activation, the switch assembly being mountable in a housing having an aperture comprising:

a non-tactile switch mounted within the housing, said switch having first and second switch circuits, each of said switch circuits being adapted to move between circuit open and circuit closed positions without providing a substantial tactile indication to the user of movement by said first and second switch circuits;

a three position trigger movably attached to the housing and coupled to said switch, said trigger being adapted to move between a first position and a second position, and between said second position and a third position;

a seal positioned between said trigger and said switch and sealably engaging the housing to close the housing aperture, said seal having a seal aperture therethrough;

a switch actuator coupling said trigger to said switch, said switch actuator extending through and being movably disposed in said seal aperture, said switch actuator being adapted to move said first switch circuit from said first circuit open position to said first circuit closed position when said trigger is moved from said first circuit said to said second position, and to move said second switch circuit from said second circuit open position to said second circuit closed position when said trigger is moved from said second position to said third position; and a tactile member positioned outward of said seal between said trigger and said switch with said seal being located between said tactile member and said switch, and positioned and adapted to be engaged by said trigger as said trigger is moved from said first position toward said second position and from said second position to said third position, said tactile member being adapted to provide the user with a tactile indication that said second switch circuit has been moved from said second circuit open position to said second circuit closed position.

11. The switch assembly of claim 10 wherein said switch actuator sealably engages said seal as said switch actuator moves within said seal aperture.

12. A switch assembly providing a tactile indication to a user of switch activation, the switch assembly being mountable in a housing having an aperture, comprising:

a non-tactile sensor mounted within the housing, said sensor being adapted to sense a force that is exerted on said sensor without providing a substantial tactile indication to the user;

a trigger movably attached to the housing, said trigger being adapted to move between a first position and a second position, said trigger being coupled to said sensor to exert the force on said sensor when said trigger is moved from said first position to said second position;

a trigger biasing member attached to said trigger, said trigger biasing member biasing said trigger toward said first position and providing resistance to said trigger when said trigger is moved toward said second position.

a sensor actuator coupling said trigger to said sensor, said sensor actuator being adapted to transmit the force from the trigger to the sensor when said trigger is moved from said first position to said second position;

a seal positioned between said trigger and said sensor and sealably engaging the housing to close the housing aperture, said seal has a seal aperture therethrough and said sensor actuator extends through and is movably disposed in said seal aperture; and a tactile member positioned outward of said seal, between said trigger and said sensor with said seal being located between said tactile member and said sensor, and adapted to be engaged by said trigger as said trigger is moved from said first position toward said second position, and to provide the user with a tactile indication that the force has been exerted on said sensor.

13. The switch assembly of claim 12 wherein said sensor actuator sealably engages said seal as said sensor actuator moves within said seal aperture.

14. The switch assembly of claim 12 wherein said tactile member is a resilient, collapsible dome adapted to be moved from an arched position to a collapsed position when said trigger is moved toward said second position, said dome being adapted to snap with a snapping action into said collapsed position, said snapping action creating said tactile indication that is transmitted through said trigger and detectable by the user, said dome being biased toward said arched position.

15. The switch assembly of claim 12 wherein said tactile member is mounted on said trigger, said tactile indication being transmitted through said trigger and being detectable by the user.

16. A switch assembly providing a tactile indication to a user of switch activation, the switch assembly being mountable in a housing having an aperture, comprising:

a non-tactile switch mounted within the housing, said switch being adapted to move between an open position and a closed position without providing a substantial tactile indication to the user of movement by said switch;

a trigger movably attached to the housings said trigger being pivotally attached to said housing and adapted to move between a first position and a second position, said trigger being coupled to said switch to move said switch from said open position to said closed position when said trigger is moved from said first position to said second position;

a seal positioned between said trigger and said switch and sealably engaging the housing to close the housing aperture, said seal having an aperture therethrough;

a switch actuator coupling said trigger to said switch, said switch actuator extending through said aperture in said seal and being movably disposed in said seal aperture, said switch actuator being positioned and adapted to move said switch from said open position to said closed position when said trigger is moved from said first position to said second position; and a tactile member positioned outward of said seal, between said trigger and said switch with said seal being located between said tactile member and said switch, and adapted to be engaged by said trigger as said trigger is moved from said first position toward said second position, and to provide the user with a tactile indication that said switch has been moved from said open position to said closed position.

* * * * *

UNITED STATES PATENT AND TRADEMARK OFFICE

CERTIFICATE OF CORRECTION

PATENT NO. : 5,510,589
DATED : April 23, 1996
INVENTOR(S) : Kevin R. Arnal

It is certified that error appears in the above-indentified patent and that said Letters Patent is hereby corrected as shown below:

In column 8, claim 3, line 27, following "claim", please delete "i" and insert therefor--1--.

In column 8, claim 10, line 59, following "aperture", please insert--,--.

In column 9, claim 10, line 12, please delete "circuit said" and insert therefor--position--.

In column 10, claim 16, line 32, please delete "housings" and insert therefor--housing--.

Signed and Sealed this

Sixteenth Day of July, 1996

*Attest:*

Bruce Lehman

BRUCE LEHMAN

*Attesting Officer*

*Commissioner of Patents and Trademarks*